US005761768A

United States Patent [19]

Wolf et al.

[11] Patent Number: 5,761,768

[45] Date of Patent: Jun. 9, 1998

[54] FLEXIBLE HINGE MECHANISM

[76] Inventors: Jerry Wolf, R.R. #1, CO Rd. 97, House #07238, Wharton, Ohio 43359; Michael Munger, RR #4, Harrow, Ontario, Canada, N0R 1G0

[21] Appl. No.: 752,690

[22] Filed: Nov. 19, 1996

[30] Foreign Application Priority Data

Jun. 24, 1996 [CA] Canada ..... 2179803

[51] Int. Cl.[6] ..... E05D 1/00

[52] U.S. Cl. ..... 16/225; 16/268; 16/382; 16/DIG. 13

[58] Field of Search ..... 16/225, 268, DIG. 13, 16/221, 223, 383, 382

[56] References Cited

U.S. PATENT DOCUMENTS

| | | | |
|---|---|---|---|
| 2,745,133 | 5/1956 | McWethy | 16/225 |
| 3,326,268 | 6/1967 | Dixon | 16/225 |
| 3,592,354 | 7/1971 | Nielsen | 16/225 |
| 3,633,316 | 1/1972 | Belser | 16/225 |
| 4,014,438 | 3/1977 | O'Toole et al. | 16/DIG. 13 |
| 4,670,938 | 6/1987 | Fowlston | 16/225 |
| 4,828,004 | 5/1989 | Martinez et al. | 160/229.1 |
| 5,148,850 | 9/1992 | Urbanick | 16/225 |
| 5,513,909 | 5/1996 | Teich | 16/225 |

FOREIGN PATENT DOCUMENTS

| | | | |
|---|---|---|---|
| 3514765 | 10/1986 | Germany | 16/225 |
| 2247717 | 3/1992 | United Kingdom | 16/225 |
| WO9214900 | 9/1992 | WIPO . | |

*Primary Examiner*—Chuck Mah
*Attorney, Agent, or Firm*—Kohn & Associates

[57] ABSTRACT

The present invention is a flexible hinge assembly. The hinge component includes a flexible body having a flange extending lengthwise down each side. The body has a groove cut into it extending lengthwise. The body is inserted into an opening in a frame until the flanges engage the upper surface of the frame. Halfway across the opening, two thin bars extend from each end. These bars enter the groove in the top of the flexible body as it is inserted in the opening, thereby holding the flanges in contact with the surface of the frame. The flexible body may be directly attached to an article to be hinged or it may be connected to an attachment device.

15 Claims, 1 Drawing Sheet

FLEXIBLE HINGE MECHANISM

FIELD OF THE INVENTION

This invention relates to a hinge assembly and, in particular, to a flexible hinge assembly.

BACKGROUND OF THE INVENTION

Typically, windows and other articles are hinged to a metal or wooden frame by hinges made of metal plates with hinge pins. Often, small holes are cut into the glass for placement of metal screws attaching the glass to the metal hinge from the frame. These metal hinges and screws are subject to corrosion and rusting. To prevent such rusting and provide for easier operation, it is advisable to oil the metal hinges and screws from time to time. Not only is this messy but it requires an adequate maintenance schedule to keep rust from forming. Moreover, the use of metal hinges results in an inferior appearance on the inside surface of the article due to the objectionable appearance of the metal hinges and any corrosion thereon.

Often, the use of metal hinges and screws is impractical or undesirable. It may be difficult to place a screw hole in the article to be hinged or the possibility of further damage occurring to the article may make this course of action undesirable. For example, with an automobile sunroof, small screw holes are placed in the glass inset. These holes weaken the integrity of the glass and may lead to cracking. Also, although some type of weatherstripping is placed in the hole around the metal screws, it often fails to remain intact and allows water and cold air to enter the vehicle causing discomfort to passengers and damage to the internal compartment of the vehicle.

Another problem with prior art hinges is that plastic, one piece hinges cannot be reused or easily replaced. The plastic hinge is affixed to the window with glue. Removing the glue destroys the hinge and requires the entire hinge to be replaced.

There, therefore, is a need for a hinge assembly which can overcome the disadvantages of the prior art and provide an effective hinge assembly for all types of articles regardless of the material with which they are manufactured.

SUMMARY OF THE INVENTION

The present invention overcomes the disadvantages of prior assemblies and provides a hinge assembly which does not use metal or corrosive material.

It is a general object of the present invention to provide a self locking hinge assembly which is flexible, easily manufactured at a low cost and which can be utilized for a number of different articles regardless of the material with which the article is made.

According to the present invention then, there is provided a flexible hinge assembly comprising a flexible hinge component, means for receiving and retaining said flexible hinge component, and means for attaching said flexible hinge component to an article.

BRIEF DESCRIPTION OF THE DRAWINGS

Preferred embodiments of the present invention will now be further described in greater detail and will be better understood when read in conjunction with the accompanying drawings, in which.

DETAILED DESCRIPTION

Figure 1:
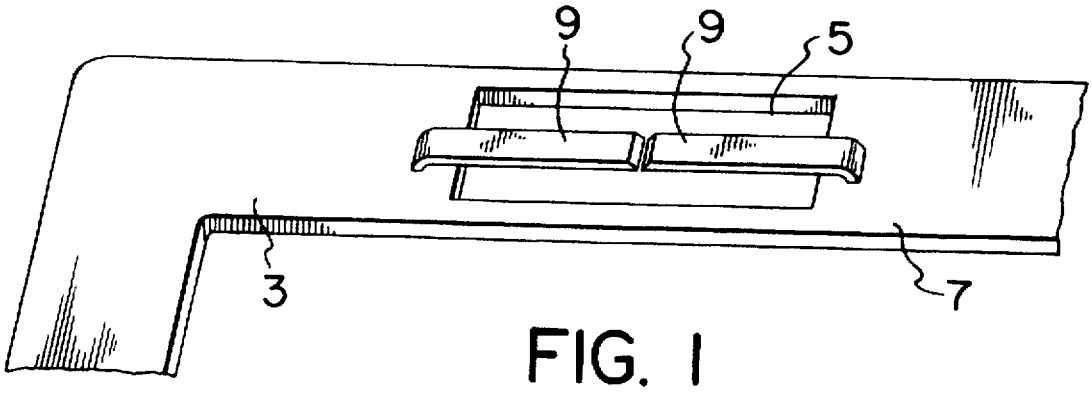
FIG. 1 is a perspective view of the frame portion of the flexible hinge assembly of the present invention.

With reference to the drawings, there is provided a selflocking flexible hinge assembly 1 for hinging two articles together comprising a first member 3 having an opening 5 therein and a flexible hinge component 11 insertable in said opening 5. The flexible hinge component 11 can accommodate an article 13 and hinges that article 13 to the first member 3 which in turn will be affixed to a structural framework, eg. a door frame of a car. One preferred use of the flexible hinge assembly is to hinge a window to a frame assembly in for example an automobile sunroof or door window.

The frame 3 is designed for permanent attachment to the structural framework of a vehicle. However, one part of the hinge, the flexible hinge component 11, can be easily replaced, if necessary for example if the window breaks.

Referring to FIG. 1, the first member 3 is a frame, eg. a frame dimensioned to fit precisely in a cut out in an automobile roof or door. The frame 3 has a generally rectangular shape with an upper surface 7 and a lower surface 8. It will be understood that the frame 3 may be designed in any shape in accordance with its desired use. It is preferably made of a substantially rigid material. Within the structure of the frame 3 is an opening 5. The opening 5 has the same shape as the flexible hinge component 11 and will vary in size in order to provide a hinge mechanism of sufficient strength and contact between the frame 3 and the article to be hinged 13. The frame 3 may have more than one rectilinearly arranged opening 5, each receiving a flexible body 11, particularly where either article is large or odd shaped. The frame 3 may also have weatherstripping attached to its upper surface to provide for a weathertight contact between the frame and a window.

Extending from the upper surface of the structure of the member or frame 3 at opposing ends of the opening 5 are two retainer arms 9. The retainer arms 9 are long narrow slats extending across the opening 5 and engaging the flexible hinge component 11 when it is fully inserted into the opening 5. The arms 9 meet at approximately the centre of the opening 5 but preferably the end of each arm 9 does not join with the other arm 9. The retainer arms 9 and the frame 3 preferably form an integral structure and are made from a substantially rigid material. The arms 9 have limited movement but can be forced slightly outward by the flexible hinge component 11 as it is inserted into the opening 5. The retainer arms 9 will then return substantially to their original position and engage the flexible hinge component 11, thereby firmly retaining the hinge component 11 in the opening 5. Several variations of the retainer arms 9 not shown in the Figures may be employed. For example, the frame 3 may contain one or more arms 9 which extend partial or completely across the opening 5.

Figure 2:
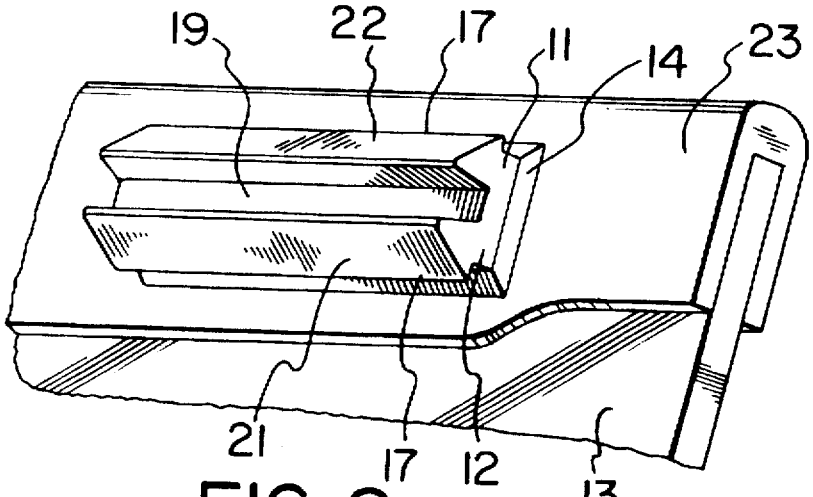
FIG. 2 is a perspective view of the hinge body portion of the flexible hinge assembly of the present invention.
Figure 3:
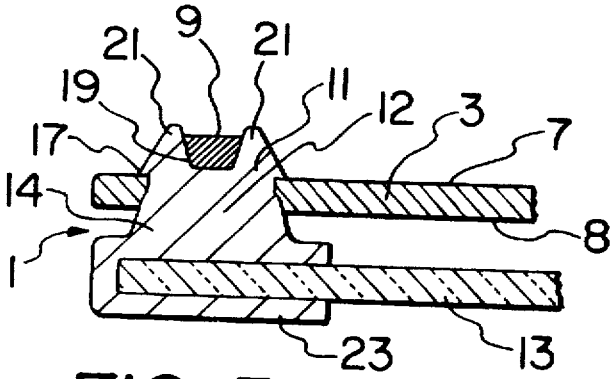
FIG. 3 is a side elevational view of the flexible hinge assembly of FIG. 1 and 2 in operative assembly.

The flexible hinge component 11 is shown in detail in FIG. 2. It is preferably made of a flexible material such as a flexible plastic and has the same general shape as the opening 5 in the frame 3. The flexible hinge component comprises a flexible body 12 having an anchoring flange 17 positioned longitudinally along at least one of its sides and extending outward therefrom. The embodiment shown in FIG. 2 and 3 shows an anchoring flange 17 longitudinally along each of the two side surfaces of the flexible body 12.

Each anchoring flange 17 is a small portion of flexible material which extends beyond the side surface of the flexible body 12. The anchoring flanges 17 contact the upper surface 7 of the frame 3 when the flexible body 12 is fully inserted into the opening 5 and in an operable position. The purpose of the anchoring flanges 17 is to maintain the flexible body 12 in the frame opening 5.

The body 12 may have slightly inwardly sloping sides extending from its base 14 which may be slightly larger than the opening 5. When the flexible body 12 is inserted into the opening 5, the sloping walls of the body 12 force the edges of the frame around the opening 5 upward, pushing them against the anchoring flanges 17 and further anchoring the flexible body 12 within the opening 5.

The upper portion of the flexible body 12 contains a deep longitudinal groove 19. The groove 19 extends to a depth corresponding to approximately the position of the anchoring flanges 17 and is defined by sides 21 and 22. This groove 19 allows the sides 21, 22 of the body to flex inward during insertion of the body 12 into the frame opening 5 to allow the anchoring flanges 17 on the side surface of the flexible body 12 to be inserted through the opening 5 and contact the upper surface 7 of the frame 3. The groove 19 is adapted to receive the retainer arms 9 of the frame 3 when the body 12 is fully inserted in the opening 7.

As the flexible body 12 is inserted into the opening 5 in the frame 3, the sides 21, 22 of the upper portion of the body 12 are forced inward pushing against the retainer arms 9 and flexing them slightly outward. When the anchoring flanges 17 along the sides of the flexible body 12 are pushed through the opening 5, they contact and grip the upper surface 7 of the frame 3, and the sides 21, 22 return to their original position, thereby opening up groove 19. As the sides 21, 22 return to their original position, the retainer arms 9 also return to their original position thereby entering groove 19 in the flexible body 12. The retainer arms 9 force the sides 21,22 of the groove 19 further outward thus further pushing the anchoring flanges 17 against the upper surface 7 of the frame 3 and locking the body 12 in the opening 5 of the frame 3.

The flexible body 11 may be attached to a window or other article by various means well known in the art. Preferably, as is shown in FIGS. 2 and 3, the body 12 is attached at its base 14 to a U—shaped strip 23. This strip 23 slips over the end of a window or other article to grip and retain the edge thus allowing the window 13 to be hinged to the frame 3. The flexible hinge component 11 is preferably integrally formed with the strip 23. The strip 23 may have one or more flexible hinge components 11 spaced along its length.

The flexible hinge component 11 and strip 23 may be removed from the hinged article. Generally, methods of removing the hinge component or strip, for example by stripping, scraping or through the use of solvents, may damage it and it would therefore need to be replaced. These components are easily and inexpensively manufactured and can be replaced on a vehicle with no damage or bodywork to the vehicle itself and with minimal labour. This hinge assembly is particularly useful where a window in a vehicle is broken and the window and hinge component must both be replaced.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. A flexible hinge assembly comprising:

a flexible body having an upper surface and a lower surface with a groove therein and at least one side surface having flange means extending therefrom;

frame means for receiving and retaining said flexible body and having an opening for receiving said flexible body therein; and.

retaining means extending from said frame means and adapted to engage said groove in said flexible body for maintaining said flexible body in said opening.

2. The hinge assembly of claim 1 further including means for attaching said flexible body to a first article.

3. The hinge assembly of claim 2 wherein said frame means is a frame adapted to attach to a second article for hinging to said first article.

4. The hinge assembly of claim 2 wherein said frame means is an integral part of said second article.

5. The hinge assembly of claim 2 wherein said retainer means includes retainer arms extending at least partially across said opening in said frame means for engaging said groove.

6. The hinge assembly of claim 5 wherein said retainer means includes two resilient retainer arms, each said arm extending partially across said opening towards the other said arm.

7. The hinge assembly of claim 6 wherein said at least one side surface of said flexible body has two longitudinally extending side surfaces and said flange means comprises a longitudinally extending flange extending outward from each of said side surfaces whereby said flanges engage said frame when said flexible body is inserted in said opening and said flanges have passed through said opening.

8. The hinge assembly of claim 7 wherein said means for attaching said flexible body to a first article comprises a strip attached to said body and attachable to said first article.

9. The hinge assembly of claim 8 wherein said strip has a generally U-shape configuration and is slidably received over one end of said second article.

10. A flexible hinge assembly comprising:

a frame having a substantially rigid structure and having an opening therein;

a flexible body for insertion into said opening and having a longitudinal groove defined therein;

means on said body for engaging said frame when said body is inserted into said opening and including at least one flange extending longitudinally along a side surface of said flexible body;

attachment means for attaching said flexible body to an article for hinging said article to said frame; and retainer means connected to said frame for engaging said groove in said flexible body when said body is inserted in said opening.

11. A flexible hinge assembly according to claim 10 wherein said retainer means comprises at least one retainer arm extending from said frame to at least partially across said opening.

12. A flexible hinge assembly according to claim 11 wherein said retainer means is integrally formed with said frame.

13. A flexible hinge assembly according to claim 12 wherein said attachment means is a generally U-shaped strip adapted to be securably received over one end of said article.

14. A flexible hinge assembly according to claim 13 wherein said attachment means and said flexible body are integrally formed.

15. A flexible hinge assembly comprising:

a frame having an opening therein, said frame having integrally formed retainer arms extending therefrom across at least part of said opening;

a hinge component receivable within said opening comprising a flexible body having a base, slightly inwardly sloping sides, flanges extending longitudinally along each side of said body, and a longitudinal groove in its upper surface for receiving said retainer arms when said hinge component is inserted within said opening; and attachment means on said base of said hinge component having a generally U-shaped configuration for attaching said hinge component to an article for hinging said article and said frame.

* * * * *